US005860395A

United States Patent [19]

Klotz et al.

[11] Patent Number: 5,860,395

[45] Date of Patent: Jan. 19, 1999

[54] PISTON COOLING BY OIL FLOW FROM A POCKET RESERVOIR AND PASSAGEWAY FORMED IN THE PISTON

[75] Inventors: James R. Klotz, Mt. Clemens; Gary Pace, Rochester; Dennis A. Soltis, Goodrich, all of Mich.

[73] Assignee: Chrysler Corporation, Auburn Hills, Mich.

[21] Appl. No.: 923,148

[22] Filed: Sep. 4, 1997

[51] Int. Cl.[6] ..... F01P 3/06

[52] U.S. Cl. ..... 123/41.35; 123/196 AB

[58] Field of Search ..... 123/41.35, 196 AB, 123/196 M, 41.33

[56] References Cited

U.S. PATENT DOCUMENTS

| | | | |
|---|---|---|---|
| 2,497,781 | 2/1950 | Logashkin | 123/41.35 |
| 4,901,679 | 2/1990 | Hodgkins et al. . | |
| 4,945,864 | 8/1990 | Solomaon et al. | 123/41.39 |
| 4,979,473 | 12/1990 | Lee . | |
| 4,995,346 | 2/1991 | Hudson, Jr. . | |
| 5,118,263 | 6/1992 | Fritchman | 417/415 |
| 5,655,495 | 8/1997 | Richards . | |

*Primary Examiner*—John T. Kwon
*Attorney, Agent, or Firm*—Kenneth H. Maclean

[57] ABSTRACT

An apparatus and a method of cooling a piston by passing a stream of lubricating oil against the underside of the piston and more specifically by providing an enclosed reservoir space between the engine cylinder wall and the side wall of the piston formed by a depression in the piston and providing a passageway in the piston aimed to direct oil to a desired location on the undersurface of the piston.

8 Claims, 3 Drawing Sheets

PISTON COOLING BY OIL FLOW FROM A POCKET RESERVOIR AND PASSAGEWAY FORMED IN THE PISTON

FIELD OF INVENTION

This invention relates generally to apparatus and a method of cooling a piston by a flow of lubricating oil against the underside of the piston's crown and more specifically by providing a reservoir between the engine's cylinder wall and the side wall of the piston and directing a flow through a passageway aimed at the undersurface of the piston crown.

BACKGROUND AND SUMMARY OF THE INVENTION

It is generally known to cool a piston by directing a flow of lubricating oil against the underside of the piston crown. More specifically, the prior art typically provides a nozzle or the like in the crankcase area below the piston. The nozzle is aimed so as to direct a flow of oil upward and against the underside of the piston crown. A problem with this arrangement is that the oil flow or stream passing from the nozzle to the piston passes through a very turbulent space due to the rotation of the crankshaft including its balancing weights and the movement of the connecting rods and attached piston. Consequently, the stream of oil is only marginally effective to cool the piston when the piston is near its bottom dead position or closest to the crankshaft. At other piston locations, the oil stream is easily deflected by the aforesaid turbulence.

The subject application provides apparatus for cooling a piston utilizing a reservoir forming pocket between the piston and cylinder wall to which oil is discharged from an aperture in the cylinder wall while the piston moves toward and away from its bottom dead position. Pressurized oil is pumped into the pocket reservoir and the oil is then discharged therefrom through a passageway in the piston which is aimed at the undersurface of the piston crown.

Also, a new method of piston cooling is disclosed including: forming a reservoir space between the side wall of the piston and the engine's cylinder wall; introducing oil into the reservoir space during a portion of the piston movement; providing a passageway in the piston extending from the reservoir space and aimed to direct a stream of oil against the undersurface of the piston.

Other features, objects, and advantages of the invention will become more apparent as the following description proceeds, especially when considered with the accompanying drawings and claims.

DETAILED DESCRIPTION OF THE PREFERRED EMBODIMENT

Figure 1:
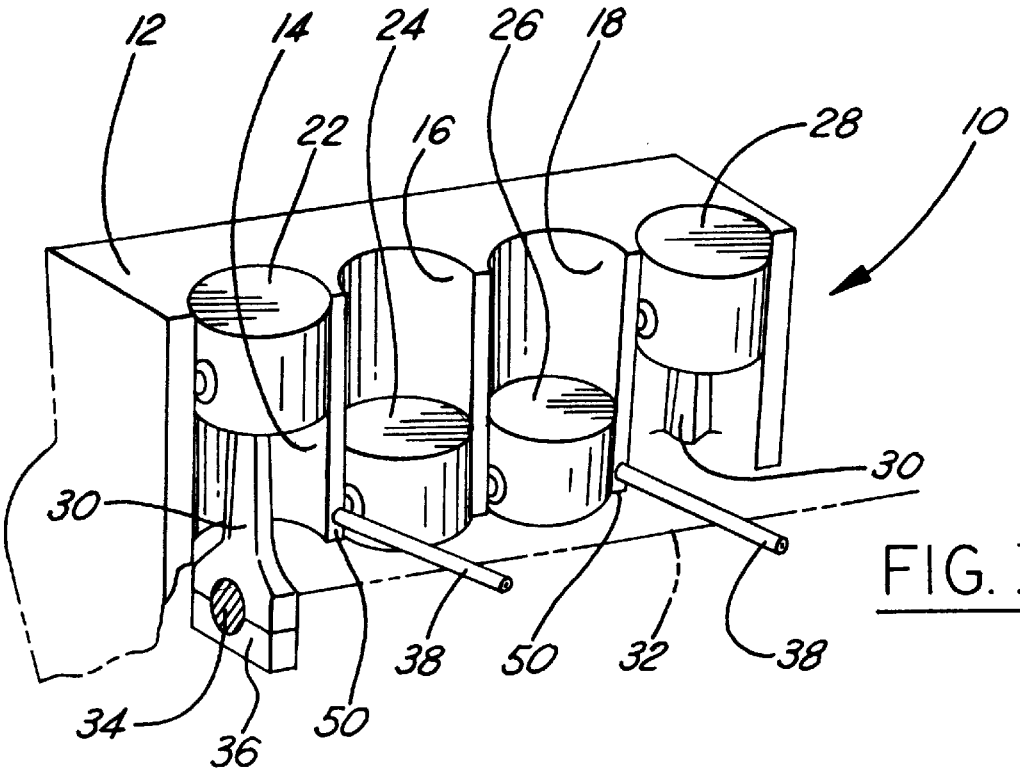
FIG. 1 is a perspective view of an engine broken away to reveal interior parts including reciprocal pistons and a piston cooling system using oil as a cooling medium.

Referring now more particularly to FIG. 1, a partial view of an internal combustion engine 10 is shown. More specifically, engine 10 includes an engine block 12 which is partially broken away to reveal four cylinder bores 14, 16, 18, and 20 respectively. Each cylinder bore supports a piston 22, 24, 26, and 28, respectively for reciprocal movement therein as is well known in the engine art. Each piston 22–28 is attached in a well known and conventional manner to the upper end portion of a connecting rod 30. In turn, each of the connecting rods 30 are attached at a lower end portion to a crankshaft which is schematically shown and identified by numeral 32. The manner of attachment between the connecting rod 30 and crankshaft 32 is well know and conventional in the engine art. Specifically, a bearing portion of the rod 30 is formed about a journal portion 34. The bearing portion includes a semi-cylindrical bearing surface formed at the lower end of the connecting rod and a correspondingly similar semi-cylindrical bearing surface formed in a separable bearing cap portion 36 of the connecting rod.

As is well known and understood in the engine art, the rotation of the crankshaft is associated with the reciprocal movements of the pistons in the cylinder bores. Although much engine structure is not shown in FIG. 1 to fully illustrate a typical engine, the missing portions are conventional and well known. During operation of an internal engine of this type, a mixture of fuel and air is burned in a combustion chamber formed partially by and above the upper or crown surface of the piston as is well known and understood in the engine art. Naturally, when fuel and air are burned in the combustion chamber, considerable heat is transferred to the piston. Much of this heat is subsequently transferred to the engine block through the piston rings and surface wall of the cylinder bore.

An additional means of transferring heat from the piston and especially the upper face or top of the piston is desirable for some engines and under severe operating conditions. The subject engine utilizes the engine's lubricating oil for piston cooling. A stream of oil is directed against the underside of the piston's top wall. Subsequently, the oil falls into the engine crankshaft housing or crankcase where it is ingested by an oil pump and is cooled by later heat transfer to the engine coolant passing through the coolant passages in the engine block. In some engines, an oil cooler may be used to transfer heat from oil to the atmospheric air. I either situation, it is beneficial to transfer heat from the upper wall of the piston.

Figure 2:
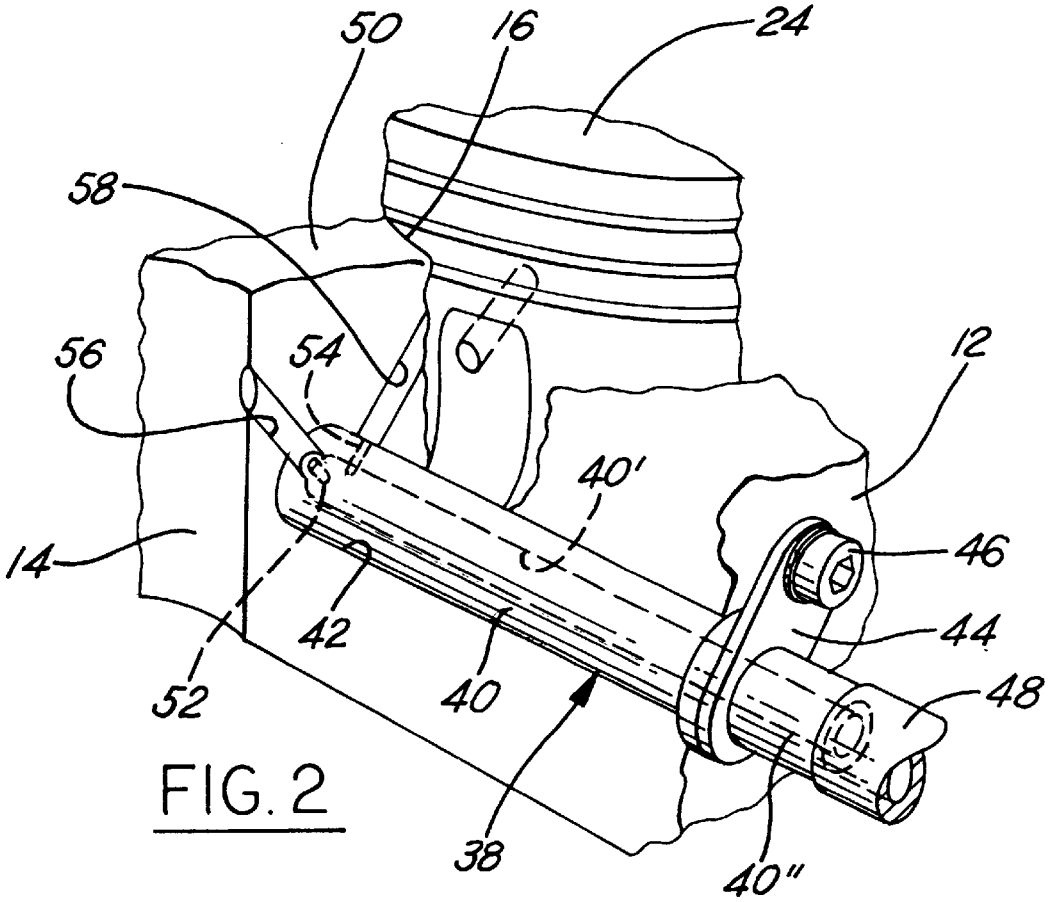
FIG. 2 is an enlarged perspective and partial view of the engine and the piston cooling system.

In FIGS. 1 and 2, portions of a piston cooling system are shown which includes a pair of conduits 38 receiving and transferring pressurized oil received from the engine's oil pump (not shown). In FIG. 2, the oil transmittal apparatus including conduits 38 take the form of a tubular member 40 which is insertably extended through a passage or bore 42 in the engine block 12. The tubular member 40 defines an interior passage 40'. The exterior or outer end portion 40" of tubular member 40 is fixed to the block 12 by a mounting plate 44 and a fastener 46. This exterior end portion 40" is connected to an oil supply conduit 48 which transmits pressurized oil into passage 40'. The aforedescribed arrangement relates to an experimental embodiment which relates to a modified production engine. Preferably, in an engine designed for the subject piston cooling system the conduits 38 would be formed as passages in the engine block and be directly connected to pressurized oil passages therein the engine block.

The pressurized oil from the oil pump is contemplated to flow through the conduit 48 and interior passage 40' to a bulkhead portion 50 of the engine block 12 located between two side by side cylinder bores such as bores 14 and 16 or bores 18 and 20. The passage 40' terminates at the bulkhead location and a pair of small diameter orifices 52 and 54 pierce through the tubular member 40. Orifices 52, 54 are aligned with a pair of larger diameter passages 56 and 58, respectively which are formed in the bulkhead portion 50 of the engine block 12. The passage 56 terminates or opens through the wall or surface of the cylinder bore 14 as shown in FIG. 2. Likewise, the passage 58 terminates or opens through the wall or surface of the cylinder bore 16. The orifices 52, 54 are sized to provide an adequate flow for piston cooling but also to limit the flow sufficiently so as to maintain a sufficient oiling of the engine's bearings.

Figure 3:
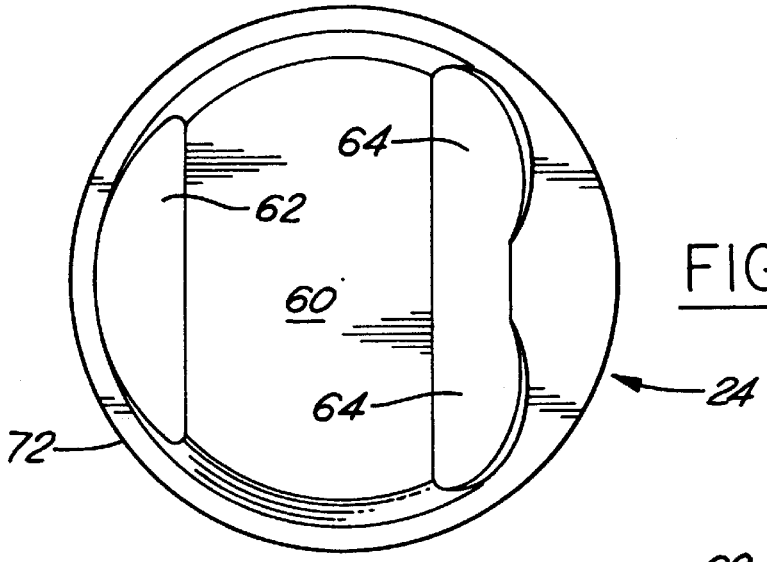
FIG. 3 is an enlarged top view of the piston shown in FIG. 2.
Figure 4:
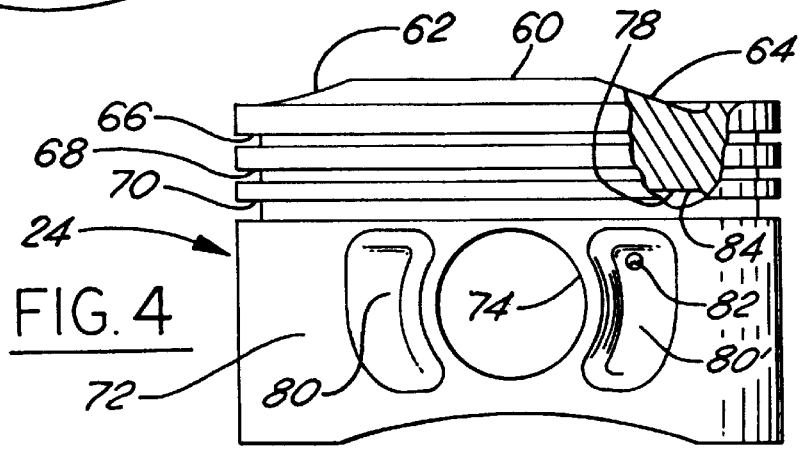
FIG. 4 is an enlarged and partially sectioned side view of the piston shown in FIG. 2.

FIGS. 3–6 reveal structural details of piston 24 but keep in mind that the other three pistons 22, 26, and 28 are identical to piston 24. The generally cylindrical shape of the piston is evident from FIGS. 3 and 6. In FIG. 3, the top surface or crown 60 of the piston is shown. The crown's left side is beveled at 62 to provide sufficient clearance for opened exhaust valves as the piston moves towards its uppermost position in the cylinder bore (see positions of pistons 22, 28 in FIG. 1). Likewise, bevels or indentations 64 are formed on the crown's right side to provide clearance for opening of intake valves. In FIG. 4, a series of grooves 66, 68, and 70 are formed in the cylindrical side surface 72 of the piston for supporting first and second piston rings and an oil seal ring, respectively.

Figure 5:
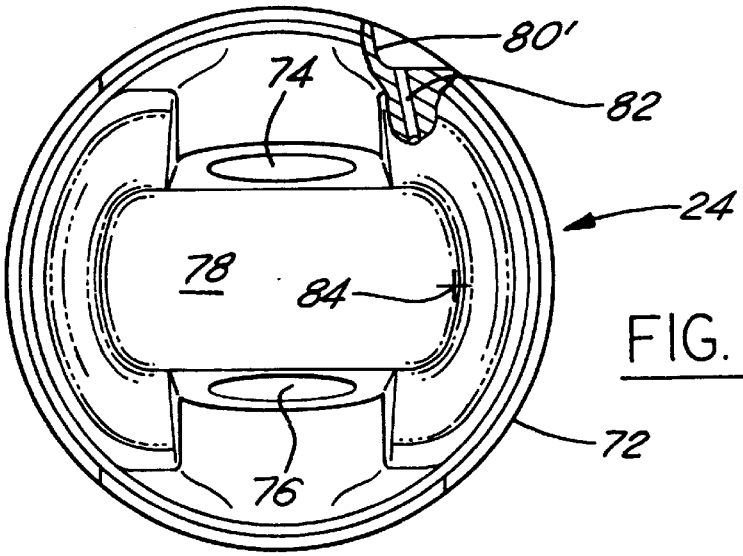
FIG. 5 is an enlarged and partially sectioned bottom view of the portion shown in FIG. 2 showing a portion of the piston cooling system.
Figure 6:
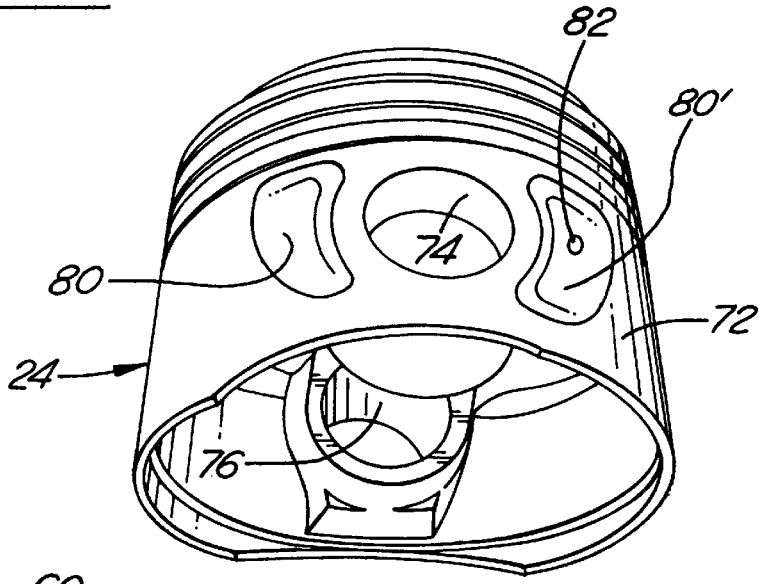
FIG. 6 is a perspective side and bottom view of the piston showing parts of the cooling system.

In FIGS. 4, 5, and 6, a pair of aligned bores 74 and 76 are shown extending radially through the piston 24. These bores 74, 76 are adapted to receive a cylindrical wrist or piston pin (not shown). The wrist pin is a conventional manner of attaching a piston to the upper end of a connecting rod which has a similar bore therethrough for allowing passage of the wrist pin. In FIG. 1, the wrist pin for each piston/connecting rod would extend longitudinally of the engine or in parallelism with the axis of the crankshaft 32.

In FIG. 5, the interior, underside 78 of the piston's top face or crown is illustrated. In addition, FIGS. 4 and 6 show shallow indentations or pockets 80 formed in the piston's cylindrical surface 72 locations to either side of the wrist pin bores 74, 76. One of the pockets 80' nearest the intake valve bevels 64 is intersected by a passage 82 in the piston. As best seen in FIG. 5, the passage 82 extends through the side wall of the piston to the piston interior defined by the side wall and crown. In FIG. 6, the piston 24 is oriented so that the line of sight is coaxial with the axis of the passage 82 so as to reveal that passage 82 is angled to direct a stream of oil from the pocket 80' for impact against the crown's underside surface 78 at the marked location 84 shown in FIG. 5.

Figure 7:
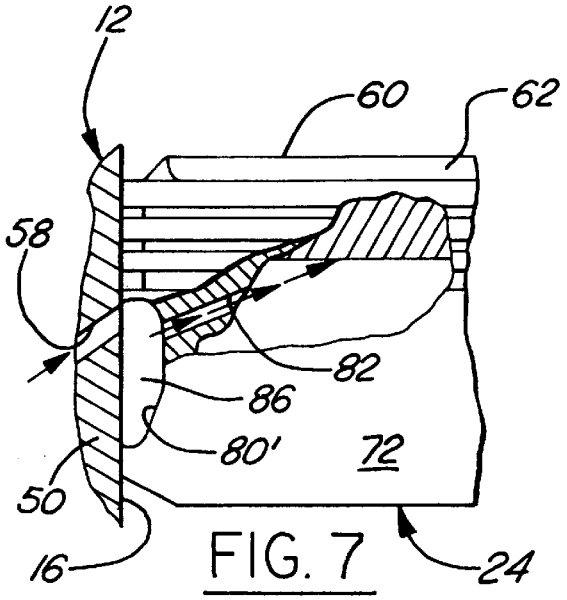
FIG. 7 is a side view of the piston when at its bottom dead center position and sectioned to reveal the piston cooling system and operation of same.
Figure 8:
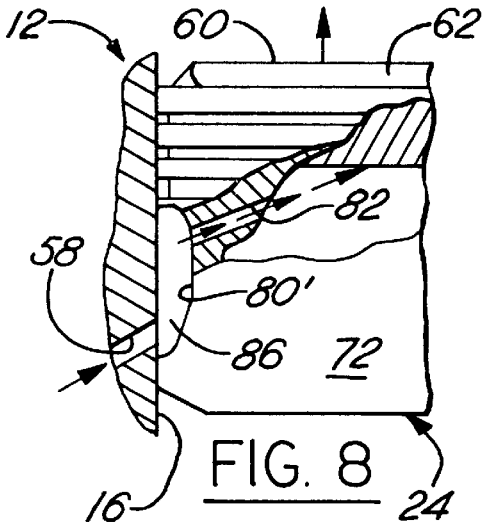
FIGS. 8 and 9 are views similar to FIG. 7 but with the piston moved upward from its bottom dead center position.
Figure 9:
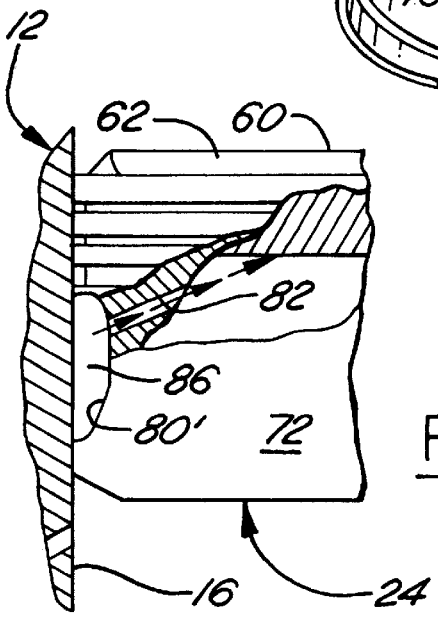

When mounted in a cylinder bore as shown in FIGS. 7–9, the pocket 80' in cooperation with the surface or wall of the cylinder bore 16 defines a substantially enclosed space 86 with only the passageway 82 continuously connected to the space. When the piston 24 moves downward toward its lowest bottom dead center position (see pistons 24, 26 in FIG. 1) as seen in FIG. 7, the inlet passage 58 communicates with the pocket 80' and space 86. As the piston moves downward toward its bottom dead center position its velocity decreases greatly and is instantaneously zero at the bottom dead center position as shown in FIG. 7. Thus the communication of passage 82 with the space 86 begins before the piston moves to its bottom dead center position and continues after the piston moves upward as shown in FIG. 8. During this portion of the piston's movement, pressurized oil is pumped into the reservoir space 86 and a stream of oil is directed from the passageway 82 against the surface 78 at the underside of the piston.

After the piston 24 has moved upward sufficiently to disconnect inlet passage 58 with reservoir space 86 as is shown in FIG. 9, the dynamics of oil in space 86 remains sufficient to direct a stream of oil toward the surface 78. After the piston decerates as it moves to its top dead center position (note the positions of pistons 22 and 28 in FIG. 1), the inertia of the oil in the reservoir space 86 causes oil in the space to be discharged out through passage 82 and against the piston's inner surface 78. It can be understood that sizing the various passages 58 and 82 will provide differing operational characteristics and durations of oil flow through passage 58.

While the above detailed description describes the preferred embodiment of the present invention, the invention is susceptible to modification, variation and alteration without deviating from the scope and fair meaning of the subjoined claims.

What is claimed is:

1. In an internal combustion engine of the type having a pressurized oil lubricating system and having at least one cylinder bore formed in an engine block an arrangement for directing a flow of oil from the oil lubricating system onto a piston surface for cooling comprising:

a source of pressurized oil;

an oil flowing fluid passage in the engine block terminating at an outlet aperture through the wall of the cylinder bore for discharge of oil;

a piston having a generally cylindrical side wall and an upper end wall for defining an interior space, said piston being formed with a generally shallow depression inwardly extending with respect to the piston's surface which depression in cooperation with the cylinder bore defines an enclosed space for passage of discharged oil from said outlet aperture whenever the position of the movable reciprocating piston is such that the enclosed space is aligned with said outlet aperture;

a passage extending from said enclosed space through the side wall of said piston and discharging into said interior space of said piston, said passage being oriented to direct a flow of oil from the passage and through the interior space toward the surface of said end wall of the piston for impacting against the piston surface wherein the oil cools the piston's end wall.

2. A system for cooling an end wall of a piston in an internal combustion engine of the type having a pressurized oil lubricating system, an engine block with at least one cylinder bore formed therein defining a cylinder wall, and a piston reciprocally supported in the cylinder bore for sliding motion with respect to said cylinder wall, the improved piston cooling system comprising: a source of pressurized oil; and oil flowing fluid passage in the engine block extending from said source of pressurized oil and terminating at an outlet aperture through the wall of said cylinder bore for discharging a flow of oil therefrom; said piston having a cylindrical side wall and an upper end wall which define an interior space, and with the side wall of said piston having a generally shallow depression inwardly extending with respect to the piston's surface which depression in cooperation with the cylinder bore defines an enclosed space therebetween for passage of oil from said outlet aperture whenever the piston is moved in said cylinder bore so that said outlet aperture communicates with said enclosed space; a passage extending through the side wall of said piston from said enclosed space for directing a flow of oil into the interior space of said piston, wherein the passage is oriented the oil discharged from the passage through the interior space and against the end surface of said piston thereby cooling the end of the piston.

3. The piston cooling system as set forth in claim 2, wherein said depression in said piston is elongated in the direction of said piston's reciprocal movement in the cylinder bore so that said enclosed space receives a flow of oil therein from said outlet aperture over an extended portion of piston's movement in said cylinder bore.

4. The piston cooling system as set forth in claim 2, wherein the end wall of said piston defines an exterior upper crown surface portion which receives heat during operation of the engine, the end wall of said piston also defining an inner surface portion which is desirable to be cooled, whereby said passage in said piston discharges oil through the interior space of said piston and against said inner surface.

5. A method for cooling a crown portion of a piston in an internal combustion engine of the type having an engine block with at least one cylinder bore therein with a wall and a piston mounted in the cylinder bore for reciprocation therein, the piston cooling method, comprising the steps of: providing a source of pressurized oil; forming a passage in said engine block terminating at an outlet aperture opening through the wall of said cylinder bore; connecting said passage with said source of pressurized oil permitting oil flow to the outlet aperture; providing an enclosed space between said cylinder wall and said piston by forming a depression projecting inwardly from the side surface of said piston; forming a passageway through said piston from said enclosed space and oriented so as to aim a stream of oil at a surface of said piston intended to be cooled.

6. The method for cooling a crown portion of a piston in an internal combustion engine as set forth in claim 5, in which said enclosed space formed by the depression in said piston is elongated in the piston's direction of reciprocal movement in said cylinder bore so that said enclosed space receives a flow of oil from said passage and its outlet aperture during a considerable degree of piston movement in said cylinder bore wherein said enclosed space can be filled with oil.

7. The method for cooling a crown portion of a piston in an internal combustion engine as set forth in claim 6, in which said outlet aperture opening through said cylinder wall is positioned so that it communicates with an uppermost region of said elongated enclosed space when the piston is located at its bottom dead center lowermost position in said cylinder bore thereby providing an extended period of time for the discharge of oil into said enclosed space from said outlet aperture as said piston first moves downward toward said bottom dead center lowermost position and subsequently as said piston moves upward from said bottom dead center lowermost position.

8. The method for cooling a crown portion of a piston in an internal combustion engine as set forth in claim 6, in which said piston defines an exterior crown surface which receives heat during operation of the engine, the crown portion also defining an interior crown surface intended to be cooled by a flow of oil thereon, whereby said flow of oil discharged from said passage in said piston directs oil against said interior crown surface.

* * * * *